US008591691B2

(12) United States Patent
Wallin

(10) Patent No.: US 8,591,691 B2
(45) Date of Patent: Nov. 26, 2013

(54) METHODS AND ARRANGEMENTS RELATING TO SURFACE FORMING OF BUILDING PANELS

(75) Inventor: Magnus Wallin, Helsingborg (SE)

(73) Assignee: Valinge Innovation AB, Viken (SE)

( * ) Notice: Subject to any disclaimer, the term of this patent is extended or adjusted under 35 U.S.C. 154(b) by 55 days.

(21) Appl. No.: 12/971,305

(22) Filed: Dec. 17, 2010

(65) Prior Publication Data

US 2011/0146188 A1 Jun. 23, 2011

Related U.S. Application Data

(60) Provisional application No. 61/287,428, filed on Dec. 17, 2009.

(51) Int. Cl.

| | |
|---|---|
| ***B29C 65/00*** | (2006.01) |
| ***B32B 37/00*** | (2006.01) |
| ***B32B 38/00*** | (2006.01) |

(52) U.S. Cl.
USPC ..... 156/257; 156/258; 156/268; 156/293; 156/304.5

(58) Field of Classification Search
USPC ..... 156/257, 268, 256, 258, 211, 212, 293, 156/304.5; 144/352, 368, 371
See application file for complete search history.

(56) References Cited

U.S. PATENT DOCUMENTS

| | | | |
|---|---|---|---|
| 1,568,605 | A | 1/1926 | Hough |
| 1,790,178 | A | 1/1931 | Sutherland |
| 2,082,186 | A | 6/1937 | Staude |
| 2,269,926 | A | 1/1942 | Crooks |
| 2,497,837 | A | 2/1950 | Nelson |
| 2,679,231 | A | 5/1954 | Pomper et al. |
| 2,791,983 | A | 5/1957 | Driskell |
| 2,811,133 | A | 10/1957 | Heino |
| 2,893,468 | A | 7/1959 | Fieroh |

(Continued)

FOREIGN PATENT DOCUMENTS

| | | | |
|---|---|---|---|
| CH | 690242 | A5 | 6/2000 |
| CN | 2095236 | U | 2/1992 |

(Continued)

OTHER PUBLICATIONS

U.S. Appl. No. 13/552,357, Bergelin, et al.

(Continued)

*Primary Examiner* — Linda L. Gray
(74) *Attorney, Agent, or Firm* — Buchanan Ingersoll & Rooney P.C.

(57) ABSTRACT

Semi-floating floorboards/building panels having mechanical joint systems, a core with curved edge portions so the surface layer on top of the core will be located below the panel surface, and where the edges of the floorboard have a bevel such that in which the joint system, when two floorboards are joined and pressed towards each other, the surface layer 31 and a part of the core 30 of the joint edge portion 19 in the second joint edge 4*b* overlaps the surface layer 31 that is substantially parallel to the horizontal plane of the first joint edge 4*a* of the other floorboard. Further, floorboards/building panels are produced by machining the surface structure with a plurality of core grooves 20, 20' and applying the surface layer 31 on the upper side of the core 30 to at least partly cover a floor element. A pressure is applied and the surface layer 31 forms around the core grooves 20, 20'.

27 Claims, 9 Drawing Sheets

(56) References Cited

U.S. PATENT DOCUMENTS

| | | | | |
|---|---|---|---|---|
| 3,050,758 | A | 8/1962 | Wilkins | |
| 3,339,525 | A | 9/1967 | Roberts | |
| 3,341,351 | A | 9/1967 | Brewer | |
| 3,354,867 | A | 11/1967 | Pomper et al. | |
| 3,440,790 | A | 4/1969 | Nerem | |
| 3,508,523 | A | 4/1970 | De Meerleer | |
| 3,627,608 | A | 12/1971 | Steiner et al. | |
| 3,825,381 | A | 7/1974 | Dunning et al. | |
| 3,932,258 | A | 1/1976 | Brinkman et al. | |
| 3,998,181 | A | 12/1976 | Bellen et al. | |
| 4,004,774 | A | 1/1977 | Houston | |
| 4,054,477 | A | 10/1977 | Curran | |
| 4,076,880 | A | 2/1978 | Geschwender | |
| 4,084,996 | A | 4/1978 | Wheeler | |
| 4,102,975 | A | 7/1978 | Doerer | |
| 4,147,448 | A | 4/1979 | Jeffery | |
| RE30,233 | E | 3/1980 | Lane et al. | |
| 4,290,248 | A | 9/1981 | Kemerer et al. | |
| 4,612,074 | A | 9/1986 | Smith et al. | |
| 4,645,481 | A | 2/1987 | Klapp | |
| 4,716,700 | A | 1/1988 | Hagemeyer | |
| 4,751,957 | A | 6/1988 | Vaught | |
| 4,850,838 | A | 7/1989 | Wagner et al. | |
| 5,096,408 | A | 3/1992 | Bielfeldt | |
| 5,111,579 | A | 5/1992 | Andersen | |
| 5,190,088 | A | 3/1993 | Thomassen et al. | |
| 5,213,819 | A | 5/1993 | Bielfeldt | |
| 5,322,584 | A * | 6/1994 | Severson et al. | 156/257 |
| 5,349,796 | A | 9/1994 | Meyerson | |
| 5,497,589 | A | 3/1996 | Porter | |
| 5,582,906 | A | 12/1996 | Romesberg et al. | |
| 5,587,218 | A | 12/1996 | Betz | |
| 5,613,894 | A | 3/1997 | Delle Vedove | |
| 5,641,553 | A | 6/1997 | Tingley | |
| 5,671,575 | A | 9/1997 | Wu | |
| 5,755,068 | A | 5/1998 | Ormiston | |
| 6,006,486 | A | 12/1999 | Moriau et al. | |
| 6,101,778 | A | 8/2000 | Martensson | |
| 6,115,926 | A | 9/2000 | Robell | |
| 6,126,883 | A | 10/2000 | Troetscher et al. | |
| 6,146,252 | A | 11/2000 | Martensson | |
| 6,180,211 | B1 | 1/2001 | Held | |
| 6,260,326 | B1 | 7/2001 | Muller-Hartburg | |
| 6,332,733 | B1 | 12/2001 | Hamberger et al. | |
| 6,345,481 | B1 | 2/2002 | Nelson | |
| 6,374,880 | B2 | 4/2002 | MacPherson et al. | |
| 6,401,415 | B1 | 6/2002 | Garcia | |
| 6,446,405 | B1 | 9/2002 | Pervan | |
| 6,532,709 | B2 | 3/2003 | Pervan | |
| 6,617,009 | B1 | 9/2003 | Chen et al. | |
| 6,679,011 | B2 | 1/2004 | Beck et al. | |
| 6,722,809 | B2 | 4/2004 | Hamberger et al. | |
| 6,769,218 | B2 | 8/2004 | Pervan | |
| 6,786,019 | B2 | 9/2004 | Thiers | |
| 6,833,039 | B2 * | 12/2004 | Andersen et al. | 156/72 |
| 6,922,964 | B2 | 8/2005 | Pervan | |
| 7,022,189 | B2 | 4/2006 | Delle Vedove et al. | |
| 7,047,697 | B1 | 5/2006 | Heath | |
| 7,101,438 | B2 | 9/2006 | Suzuki et al. | |
| 7,137,229 | B2 | 11/2006 | Pervan | |
| 7,386,963 | B2 | 6/2008 | Pervan | |
| 7,866,115 | B2 | 1/2011 | Pervan et al. | |
| 7,926,234 | B2 | 4/2011 | Pervan et al. | |
| 8,042,484 | B2 | 10/2011 | Pervan et al. | |
| 8,261,504 | B2 | 9/2012 | Hakansson | |
| 2002/0014047 | A1 | 2/2002 | Thiers | |
| 2002/0023702 | A1 | 2/2002 | Kettler | |
| 2002/0056245 | A1 | 5/2002 | Thiers | |
| 2002/0189183 | A1 | 12/2002 | Ricciardelli | |
| 2003/0041545 | A1 | 3/2003 | Stanchfield | |
| 2003/0101674 | A1 | 6/2003 | Pervan et al. | |
| 2003/0159385 | A1 | 8/2003 | Thiers | |
| 2004/0035077 | A1 | 2/2004 | Martensson | |
| 2004/0062937 | A1 * | 4/2004 | Lyons | 428/455 |
| 2004/0108625 | A1 | 6/2004 | Moder et al. | |
| 2004/0244611 | A1 | 12/2004 | Ramcke | |
| 2004/0255541 | A1 | 12/2004 | Thiers et al. | |
| 2005/0028474 | A1 | 2/2005 | Kim | |
| 2005/0161468 | A1 | 7/2005 | Wagner | |
| 2005/0166514 | A1 | 8/2005 | Pervan | |
| 2005/0235593 | A1 | 10/2005 | Hecht | |
| 2005/0281997 | A1 * | 12/2005 | Grah | 428/215 |
| 2006/0073320 | A1 | 4/2006 | Pervan et al. | |
| 2006/0110490 | A1 | 5/2006 | Nien | |
| 2006/0179773 | A1 | 8/2006 | Pervan et al. | |
| 2006/0260253 | A1 | 11/2006 | Brice | |
| 2007/0175144 | A1 | 8/2007 | Hakansson | |
| 2007/0232205 | A1 | 10/2007 | Delle VeDove | |
| 2008/0000417 | A1 | 1/2008 | Pervan | |
| 2008/0028707 | A1 | 2/2008 | Pervan | |
| 2008/0034701 | A1 | 2/2008 | Pervan et al. | |
| 2008/0066425 | A1 | 3/2008 | Jacobsson et al. | |
| 2008/0120938 | A1 | 5/2008 | Jacobsson et al. | |
| 2009/0155612 | A1 | 6/2009 | Pervan et al. | |
| 2009/0260313 | A1 | 10/2009 | Segaert | |
| 2010/0092731 | A1 * | 4/2010 | Pervan et al. | 428/172 |
| 2010/0300030 | A1 | 12/2010 | Pervan et al. | |
| 2011/0154665 | A1 | 6/2011 | Pervan | |
| 2012/0233953 | A1 * | 9/2012 | Pervan et al. | 52/588.1 |

FOREIGN PATENT DOCUMENTS

| | | | |
|---|---|---|---|
| CN | 1376230 | A | 10/2002 |
| DE | 199 07 939 | C1 | 5/2000 |
| DE | 100 32 204 | C1 | 7/2001 |
| DE | 100 08 166 | A1 | 9/2001 |
| DE | 100 34 407 | C1 | 10/2001 |
| DE | 100 57 901 | A1 | 6/2002 |
| DE | 202 06 460 | U1 | 8/2002 |
| DE | 100 08 166 | C2 | 4/2003 |
| DE | 102 32 508 | C1 | 12/2003 |
| DE | 203 14 850 | U1 | 1/2004 |
| DE | 203 17 527 | U1 | 1/2004 |
| DE | 20 2004 001 038 | U1 | 4/2004 |
| DE | 103 43 441 | B3 | 5/2005 |
| DE | 20 2005 006 300 | U1 | 7/2005 |
| EP | 0 487 925 | A1 | 6/1992 |
| EP | 0 661 135 | B1 | 12/1998 |
| EP | 1 048 423 | A2 | 11/2000 |
| EP | 1 146 182 | A2 | 10/2001 |
| EP | 1 215 352 | A2 | 6/2002 |
| EP | 1 228 812 | A1 | 8/2002 |
| EP | 1 338 344 | A2 | 8/2003 |
| EP | 1 437 457 | A2 | 7/2004 |
| EP | 1 593 795 | A1 | 11/2005 |
| EP | 1 691 005 | A1 | 8/2006 |
| EP | 1 971 735 | | 7/2007 |
| EP | 1 812 172 | A1 | 8/2007 |
| FR | 2 846 023 | A1 | 4/2003 |
| GB | 1 394 621 | A | 5/1975 |
| GB | 2 256 023 | A | 11/1992 |
| JP | 48-071434 | A | 9/1973 |
| JP | 49-031028 | B | 8/1974 |
| JP | 50-151232 | A | 12/1975 |
| JP | 55-099774 | U | 7/1980 |
| JP | 57-162668 | A | 10/1982 |
| JP | 57-185110 | A | 11/1982 |
| JP | 06-280376 | A | 10/1994 |
| JP | 8-033861 | A | 2/1996 |
| JP | 9-088315 | A | 3/1997 |
| JP | 2000-079602 | A | 3/2000 |
| JP | 2000-226932 | A | 8/2000 |
| JP | 2001-179710 | A | 7/2001 |
| JP | 2001-254503 | A | 9/2001 |
| JP | 2001-260107 | A | 9/2001 |
| JP | 2002-276139 | A | 9/2002 |
| JP | 2002-371635 | A | 12/2002 |
| JP | 2003-126759 | A | 5/2003 |
| JP | 2003-200405 | A | 7/2003 |
| JP | 2004-027626 | A | 1/2004 |
| JP | 2007-170059 | A | 7/2007 |
| SE | 525 661 | C2 | 3/2005 |
| SU | 1680359 | A1 | 9/1991 |
| WO | WO 94/26999 | A1 | 11/1994 |

(56) References Cited

FOREIGN PATENT DOCUMENTS

| | | | | |
|---|---|---|---|---|
| WO | WO 97/19232 | A1 | | 5/1997 |
| WO | WO 97/47834 | A1 | | 12/1997 |
| WO | WO 01/02103 | A2 | | 1/2001 |
| WO | WO 01/96688 | A1 | | 12/2001 |
| WO | WO 02/055809 | A1 | | 7/2002 |
| WO | WO 02/055810 | A1 | | 7/2002 |
| WO | WO 02/060691 | A1 | | 8/2002 |
| WO | WO 03/012224 | A1 | | 2/2003 |
| WO | WO 03/035352 | | * | 5/2003 |
| WO | WO 03/070384 | A1 | | 8/2003 |
| WO | WO 03/078761 | A1 | | 9/2003 |
| WO | WO 03/099461 | A1 | | 12/2003 |
| WO | WO 2005/054600 | A1 | | 6/2005 |
| WO | WO 2005/068747 | A1 | | 7/2005 |
| WO | WO 2005/077625 | A1 | | 8/2005 |
| WO | WO 2005/110677 | A1 | | 11/2005 |
| WO | WO 2006/008578 | A1 | | 1/2006 |
| WO | WO 2006/031169 | A1 | | 3/2006 |
| WO | WO 2006/038867 | A1 | | 4/2006 |
| WO | WO 2006/043893 | A1 | | 4/2006 |
| WO | WO 2006/058548 | A1 | | 6/2006 |
| WO | WO 2006/066776 | A2 | | 6/2006 |
| WO | WO 2006/088417 | A2 | | 8/2006 |
| WO | WO 2006/111437 | A1 | | 10/2006 |
| WO | WO 2006/113757 | A2 | | 10/2006 |
| WO | WO 2008/033081 | A1 | | 3/2008 |
| WO | WO 2009/065769 | A2 | | 5/2009 |
| WO | WO 2009/065769 | A3 | | 5/2009 |

OTHER PUBLICATIONS

Bergelin, Marcus, et al., U.S. Appl. No. 13/552,357 entitled "Resilient Groove," filed in the U.S. Patent and Trademark Office on Jul. 18, 2012.

U.S. Appl. No. 13/667,770, Pervan et al.

Pervan, Darko, et al., U.S. Appl. No. 13/667,770, entitled "Appliance and Method for Surface Treatment of a Board Shaped Material and Floorboard," filed in the U.S. Patent and Trademark Office Nov. 2, 2012.

U.S. Appl. No. 13/853,722, Pervan.

Pervan, Darko, U.S. Appl. No. 13/853,722 entitled "Building Panel with Compressed Edges and Method of Making Same," filed in the U.S. Patent and Trademark Office on Mar. 29, 2013.

International Search Report issued in PCT/SE2010/051418, Apr. 14, 2011, Patent-och registeringsverket, Stockholm, SE, 8 pages.

* cited by examiner

Known Art

Known Art

Known Art

Known Art

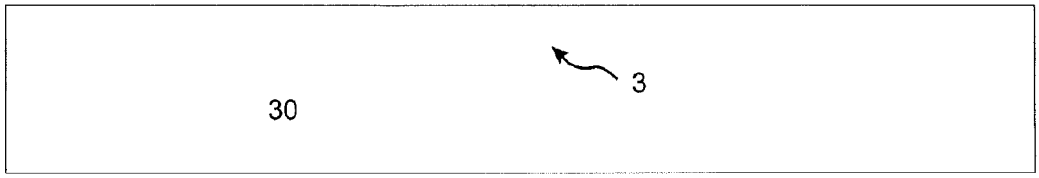
Fig. 16a
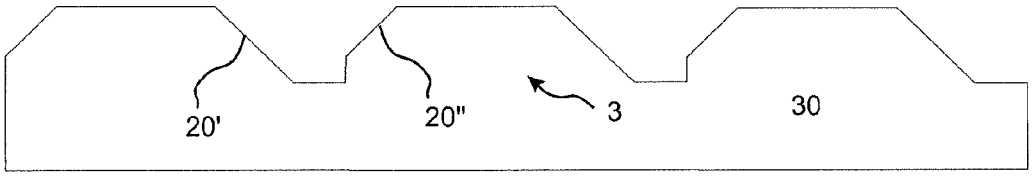
Fig. 16b
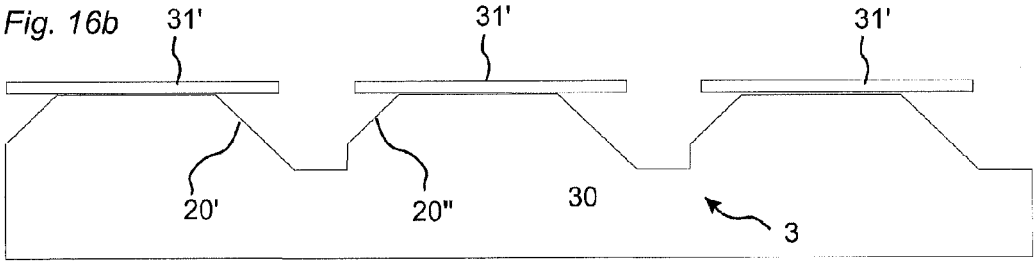
Fig. 16c
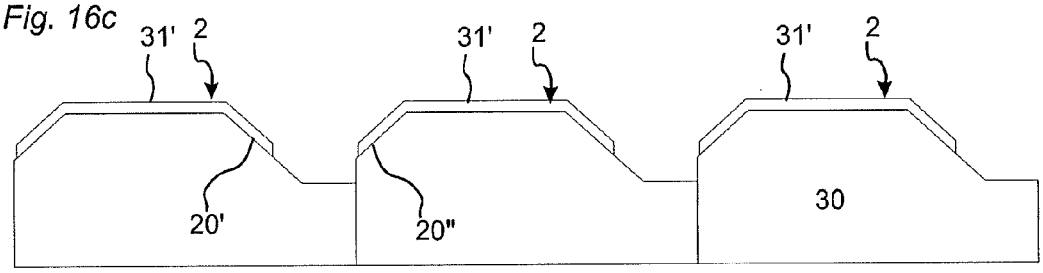
Fig. 16d
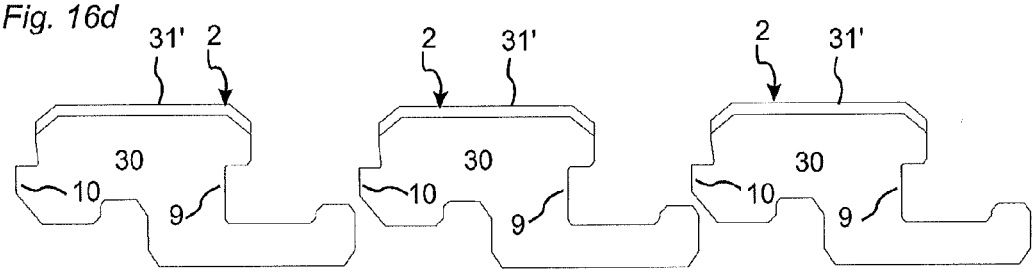
Fig. 16e
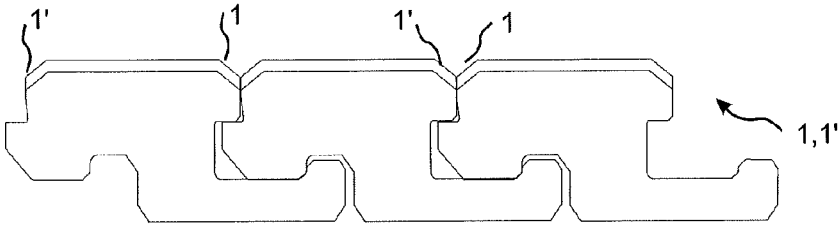
Fig. 16f
Fig. 16

METHODS AND ARRANGEMENTS RELATING TO SURFACE FORMING OF BUILDING PANELS

CROSS REFERENCE TO RELATED APPLICATIONS

The present application claims the benefit of U.S. Provisional Application No. 61/287,428, filed on Dec. 17, 2009, and claims the benefit of Swedish Application No. 0950980-3, filed on Dec. 17, 2009. The entire contents of each of U.S. Provisional Application No. 61/287,428 and Swedish Application No. 0950980-3 are hereby incorporated herein by reference.

TECHNICAL FIELD

The present invention generally concerns a method relating to manufacturing panels, especially floorboards, as well as a floorboard produced according to such method. Specifically, embodiments of the present invention relate to floorboards having mechanical joint systems, a core and a surface layer with curved edge portions located below the panel surface. Embodiments of the invention relate to a floorboard with such edge portions and a method to produce such floorboard.

FIELD OF THE APPLICATION

Embodiments of the present invention are particularly suited for use in floors with a top surface layer including wood veneer, laminate, foils, a layer of paint or a layer which comprises a mix of wood fibres, binders and wear resistant particles and the like. The following description of known technique, problems of known systems as well as objects and features of the invention will therefore as non-limiting examples be aimed mainly at this field of application. However, it should be emphasized that the invention can be used in any building panels e.g. floor panels or wall panels having a top surface layer, which are intended to be joined in different patterns by means of a joint system.

DEFINITION OF SOME TERMS

In the following text, the visible surface of the installed floor panel is called "front side", while the opposite side of the floor panel facing the subfloor is called "rear side". "Horizontal plane" relates to a plane, which is parallel to the front side. Directly adjoining upper parts of two neighboring joint edges of two joined floor panels together define a "vertical plane" perpendicular to the horizontal plane. The outer parts of the floor panel at the edge of the floor panel between the front side and the rear side are called "joint edge". As a rule, the joint edge has several "joint surfaces" which can be vertical, horizontal, angled, rounded, beveled etc. These joint surfaces may exist on different materials, for instance laminate, fiberboard, wood, plastic, metal (in particular aluminum) or sealing materials.

By "joint system" is meant cooperating connecting means which interconnect the floor panels vertically and/or horizontally. By "mechanical joint system" is meant that locking can take place without glue. Mechanical joint systems can, however, in many cases also be joined by glue.

By "locking groove side" is meant the side of the floor panel in which part of the horizontal locking means has a locking groove whose opening faces to the rear side. By "locking element side" is meant the side of the floor panel in which part of the horizontal locking means has a locking element, which cooperates with the locking groove.

By "decorative surface layer" is meant a surface layer, which is mainly intended to give the floor its decorative appearance. "Wear resistant surface layer" relates to a high abrasive surface layer, which is mainly adapted to improve the durability of the front side. A "decorative wear resistant surface layer" is a layer, which is intended to give the floor its decorative appearance as well as improve the durability of the front side. A surface layer is applied to the core.

By "WFF" is meant a powder mix of wood fibre binders and wear resistant particles and the like that is compressed under a pressure given the result of a compact surface layer with different kind of visual effect. The powder can be scattered.

BACKGROUND OF THE INVENTION, KNOWN TECHNIQUE AND PROBLEMS THEREOF

To facilitate the understanding and description of the present invention as well as the knowledge of the problems behind the invention, here follows a description of both the basic construction and the function of floorboards with reference to FIG. 1 in the accompanying drawings.

FIGS. 1*a*-1*d* show according to known art, how laminate flooring is produced. A floor element 3, FIGS. 1*a*-*b*, in the form of a large laminated board, is sawn into several individual floor panels 2, FIG. 1*c*, which are then further machined to floorboards 1, 1', FIG. 1*d*. The floor panels are individually machined along their edges to floorboards with mechanical joint systems on the edges. The machining of the edges is carried out in advanced milling machines where the floor panel is exactly positioned between one or more chains and belts or similar, so that the floor panel can be moved at high speed and with great accuracy such that it passes a number of milling motors, which are provided with diamond cutting tools or metal cutting tools and which machine the edge of the floor panel and forms the joint system.

A floorboard 1, 1', FIG. 1*d*, having a mechanical joint system has active locking surfaces in the tongue 10 (the tongue side of the floorboard 1') and the tongue groove 9 (the groove side of the floorboard 1). Laminate flooring and wood veneer flooring are usually composed of a body 30 including a 6-12 mm fiberboard, a 0.1-0.8 mm thick top surface layer 31 and a 0.1-0.6 mm thick lower balancing layer 32. The top surface layer 31 provides appearance and durability to the floorboards. The body provides stability and the balancing layer keeps the board leveled when the relative humidity (RH) varies during the year. The RH can vary between 15% and 90%.

Conventional floorboards with a wood surface were previously usually joined by means of glued tongue-and-groove joints. The edges were often formed with bevels in order to eliminate tight tolerances.

In addition to such traditional floors, floorboards have been developed in recent years, which do not require the use of glue but which are instead joined mechanically by means of so-called mechanical joint systems. These systems comprise locking means, which lock the boards horizontally and vertically. The mechanical joint systems can be formed by machining the core 30 of the board 1, 1'. Alternatively, parts of the joint system can be made of a separate material, which is integrated with the floorboard. The floorboards are joined, i.e. interconnected or locked together in a floating manner, by various combinations of angling, snapping, insertion along the joint edge and by fold down methods using joint systems comprising separate displaceable tongues generally factory inserted in a groove at the short edges.

Such floors can be formed with tight tolerances. Bevels are therefore mainly used to obtain decorative properties. A laminate floor panel with a thin surface layer can be formed with beveled edges and then looks like a solid wood plank.

The advantage of a floating flooring which is not connected to a sub floor with, for example, nails or glue, is that a change in shape due to different degrees of relative humidity RH can occur concealed under basemouldings and the floorboards can, although they swell and shrink, be joined without visible joint gaps. Installation can, especially by using mechanical joint systems, be laid quickly and easily. The drawback is that the continuous floor surface must as a rule be limited even in the cases where the floor comprises of relatively dimensionally stable floorboards, such as laminate floor with a fiberboard core or wooden floors composed of several layers with different fibre directions. The reason is that such floors as a rule shrink and swell as the RH varies.

A solution for large floor surfaces is to divide the large surface into smaller surfaces with expansion strips. Without such a division, it is a risk that the floor when shrinking will change in shape so that it will no longer be covered by basemouldings. Also the load on the joint system will be great since great loads must be transferred when a large continuous surface is moving. The load will be particularly great in passages between different rooms. Examples of expansion strips are joint profiles that are generally aluminum or plastic section fixed on the floor surface between two separate floor units. They collect dirt, give an unwanted appearance and are rather expensive. Due to these limitations on maximum floor surfaces, laminate floorings have only reached a small market share in commercial applications such as hotels, airports, and large shopping areas. More unstable floors, such as wooden floors, may exhibit still greater changes in shape. The factors that above all affect the change in shape of homogenous wooden floors are fibre direction and the kind of wood. A homogenous oak floor is very stable along the fibre direction, i.e. in the longitudinal direction of the floorboard.

The advantage of gluing/nailing to the subfloor is that large continuous floor surfaces can be provided without expansion joint profiles and the floor can take up great loads. This method of installation involving attachment to the subfloor has, however, a number of considerable drawbacks. The main drawbacks are costly installation and that as the floorboards shrink, a visible joint gap arises between the boards.

In view of the cited documents there is still a need of improving a floating floor without the above drawbacks, in particular a floating floor which a) may have a large continuous surface without expansion joint profiles, b) may have a non-visible joint gap, and c) may have a bevel with the same visual effects as for a more expensive wood based floorboard. There is still a need of improving a method for producing such a floating floor, without the above drawbacks in particular a manufacturing method which may be less complex, thereby speeding up the manufacturing and decreasing the cost.

SUMMARY OF THE INVENTION AND OBJECTS THEREOF

A first object of an exemplary embodiment of the invention is to enable improved joint systems, so floorboards are possible to be installed as semi-floating floors in large continuous surfaces even though great dimensional changes may occur as the relative humidity changes.

A second object of an exemplary embodiment of the invention is to provide joint systems, which allow considerable movement between floorboards while preventing moisture from penetrating into, or at least diminishing moisture from penetrating into, the joint gaps, and without large and deep dirt-collecting joint gaps and/or where open joint gaps can be excluded.

A third object of an exemplary embodiment of the invention is to provide joint systems, which allow a considerable movement between floorboards with bevels at the edges that are strong.

A fourth object of an exemplary embodiment of the invention is to enable improved manufacturing of wood veneer floorboards with a bevel, which can also be semi-floating.

A fifth object of an exemplary embodiment of the invention is to enable the possibility to apply a bevel to a floorboard with a production method that is less complex and thereby requires less complex machines and machines at low cost, and allow a production at high speed.

According to a first aspect, embodiments of the invention include floorboards provided with an upper decorative surface layer. The floorboards comprise a mechanical joint system at two opposite edges for locking together adjacent joint edges of two adjacent floorboards. The decorative surface layer at a first joint edge and the decorative surface layer at a second joint edge overlap each other at the mechanical joint system at an overlapping part, the overlapping part is preferably located under the horizontal main surface of the decorative surface layer, a first joint surface of the first joint edge faces a second joint surface at the second joint edge and the first and the second joint surfaces are essentially parallel and essentially horizontal.

According to the first aspect, an exemplary preferred embodiment of the invention is that the first and the second joint surfaces are in contact. Another preferred exemplary embodiment is that the first and the second joint surfaces extend in a plane which is about 0-10° to the horizontal plane.

According to a second aspect, embodiments of the invention include a method for manufacturing a floor panel, the method comprises the steps of:

- machining a plurality of core grooves in the upper horizontal surface of a floor element;
- applying a top surface layer on the core of the floor element;
- applying a pressure on at least parts of the surface layer such that the surface layer follows the surface of the floor element and at least partly at least one of the core grooves;
- cutting the floor element into at least two floor panels following at least one of the core grooves of the floor element, such that the floor panels comprise at least a part of the core groove at an edge of the floor panel.

According to the second aspect, an exemplary preferred embodiment of the invention is that the method further comprises the step of forming a mechanical joint system at the edge of the floor panel.

An advantage of some exemplary embodiments of the invention is with the special design of the mechanical joint system allowing semi-floating installation, and regardless of shrinking or swelling of the floorboard due to temperature or humidity changes, any visible openings between the floor panels are eliminated.

An advantage of some exemplary embodiments of the invention is that with the special design of the mechanical joint system allowing semi-floating installation giving the possibilities to seal the joint system from moisture without the possibilities for moisture to penetrate or with the extra help of a vapor barrier disposed either under the overlapping surface or on the surface being overlapped.

An advantage of some exemplary embodiments of the invention is that the visible joint opening will have the same kind of wood and fibre direction as the top surface layer and the appearance will be identical with that of a homogeneous wooden floor.

An advantage of some exemplary embodiments of the invention is that support is provided for an overlapping joint edge by the facing top surface layer of the locking joint edge being horizontal.

Still further advantage of some exemplary embodiments of the invention is that it enables the possibility to apply a bevel to a floorboard with a production method that is less complex and thereby requires less complex machines and machines at low cost, and production at high speed.

A further advantage of some exemplary embodiments of the invention is that a wood veneer floorboard with a bevel can be produced at a low production cost and still have the same visual effects as for a more expensive wood based floorboard, i.e. a floorboard with a thick top surface layer of solid wood floorboard.

A further advantage of some exemplary embodiments of the invention is that a floorboard with a surface of wood fibre mix with a bevel can be produced at a low production cost.

Still another advantage of some exemplary embodiments of the invention is the decreased tolerances though high-speed production of floorboards with a bevel.

The method described above for manufacturing a floor element comprising a surface following grooves or even local cavities formed in the core can also be used to form decorative depressions in the surface of a floorboard between two edges. This allows that thin surfaces with deep structures similar to, for example, grout lines, hand scraped wood, rough stone and slate shaped structures can be formed in a cost efficient way. Such structures are difficult to form with the known production methods where compression of the surface layer and/or the core is used to obtain for example local depressions in the surface.

Other objects, advantages and novel features of the invention will become apparent from the following detailed description of the invention when considered in conjunction with the accompanying drawings and claims.

BRIEF DESCRIPTION OF THE DRAWINGS

FIGS. 16*a*-16*f* are an exemplary embodiment of a summarization of the manufacturing steps in FIGS. 8-15, according to the invention.

DETAILED DESCRIPTION OF EMBODIMENTS

FIGS. 2-16 and the related description below are used to explain certain principles of the invention and to show examples of embodiments that can be used in the invention. The illustrated embodiments are only examples. It should be emphasized that all types of mechanical joint system of floorboard allowing vertical folding and/or vertical locking, can be used and applicable part of this description form a part of the present invention.

The present invention of a special design of a mechanical joint system that allows semi-floating installation, and a method for producing such building panels are particularly suited for but not limited to use in:

- Floorboards where the top surface layer includes wood veneer, laminate, layer of paint or a solid layer comprising wood fibre mix, binders and wear resistant particles or similar.
- Floorboards with a bevel having the same material as the top surface layer with the benefit of a bevel extending to the tongue of the floorboard.
- Floorboards with a bevel in combination with a play, which result in a semi-floating feature, can occur, and that the movement of the profile will not affect the visual impression with gaps.
- Wall panels in wet rooms where no gaps are allowed.
- Being less precise, the present invention is suited for any building panels having joint systems with a bevel having the same material as the top surface layer.

Figure 1A:
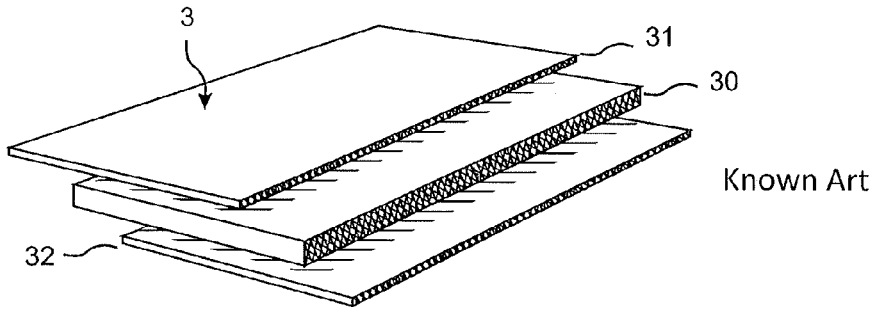
FIGS. 1*a*-1*d* are steps of how a floorboard is produced, known in the known art.
Figure 1B:
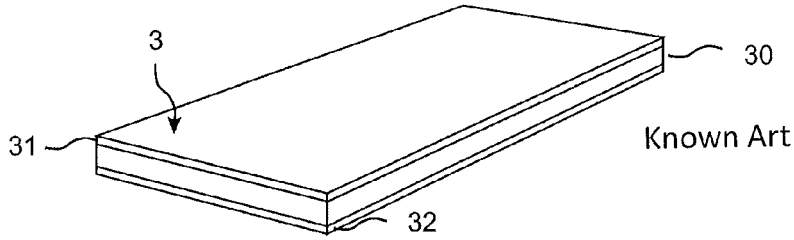
Figure 1C:
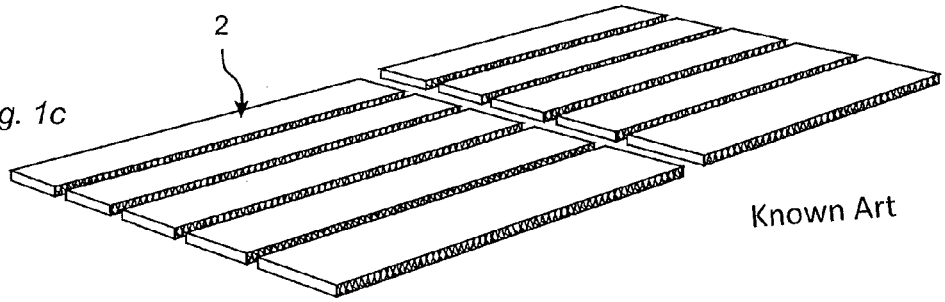
Figure 1D:
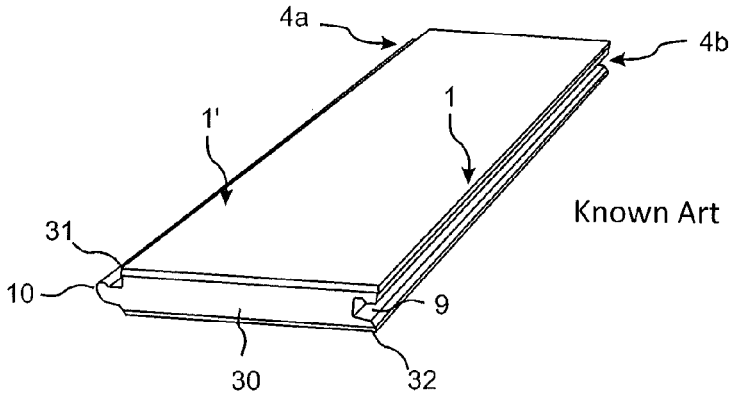
Figure 2A:
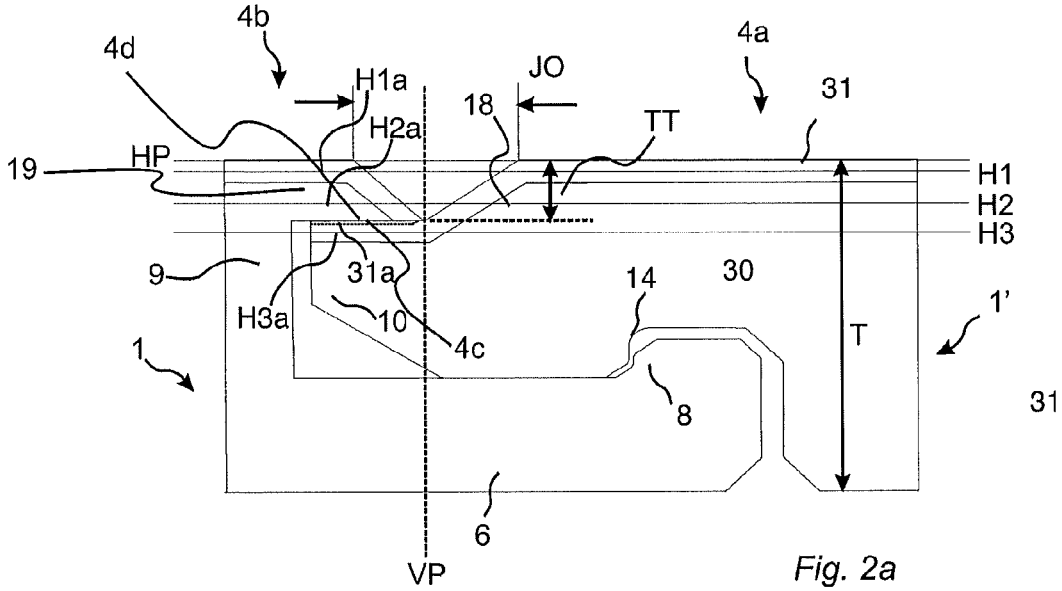
FIGS. 2*a*-2*b* are two first exemplary embodiments of a special design of a mechanical joint system that allow semi-floating installation, according to the invention.
Figure 2B:
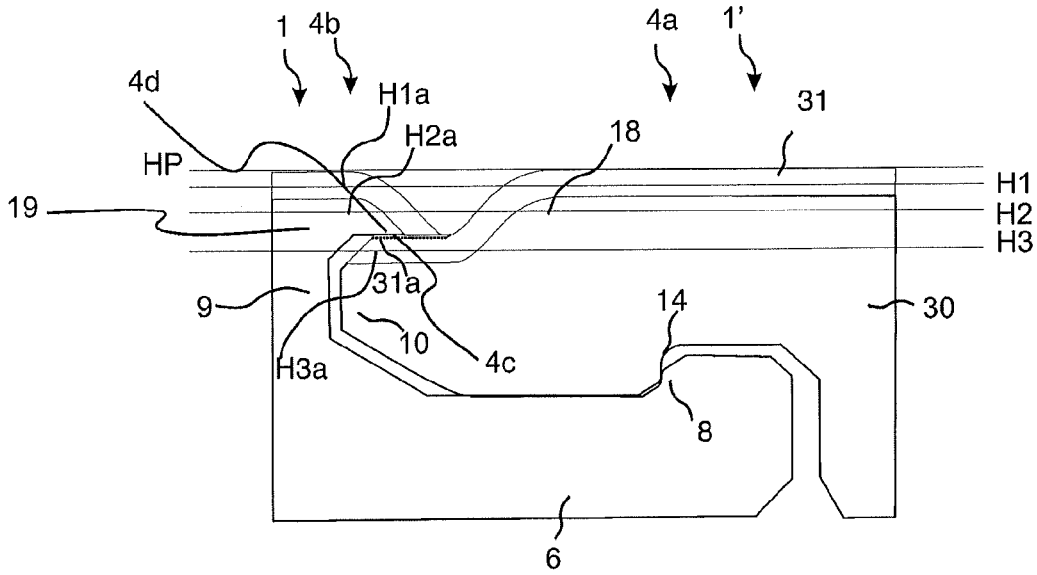

FIGS. 2*a*-2*b* illustrate first exemplary embodiments of the special design of a mechanical joint system for mechanical joining of floorboards 1, 1', that allow semi-floating installation, without a visible joint gap and without using high-grade wood, according to the invention. The floorboard comprises a surface layer 31 applied on top of a core 30. The joined floorboards have a horizontal plane (HP), which is parallel to the horizontal main floor surface and comprises outer parts of the surface layer, and a vertical plane (VP), which is perpendicular to the horizontal plane. The joint system has mechanically cooperating locking means for vertical joining parallel to the vertical plane and for horizontal joining parallel to the horizontal plane of a first and a second joint edge 4*a*, 4*b*. The vertical locking means comprises a tongue 10, which cooperates with a tongue groove 9. The horizontal locking means comprise a strip 6 with a locking element 8, which cooperates with a locking groove 14. The floorboards 1, 1' have, in an area TT of a first 4*a* and second 4*b* joint edge a first 18 and second 19 joint edge portion which are defined by the area between the upper parts of the tongue groove 9 and the horizontal plane HP.

FIGS. 2*a*-2*b* show edge parts which are sharp in FIG. 2*a* or rounded in FIG. 2*b* and comprise a first upper horizontal plane H1 extending through a surface layer 31, a second intermediate horizontal plane H2 extending through a part of the panel core 30 and a lower horizontal plane H3 extending through a portion of the surface layer 31.

FIG. 2*a* illustrates surface layer H1*a* in the upper first horizontal plane H1 parallel to the main floor surface HP, surface layer H3*a* in the lower third horizontal plane H3 located under the main floor surface HP, and a part of the core H2*a* in the second horizontal plane H2 between first and third horizontal planes H1, H3. When the floorboards 1, 1' are joined and pressed towards each other the surface layer H1*a* and core H2*a* of the upper joint edge portion 19 in the second joint edge 4*b* overlap the surface layer H3*a* of the first joint edge 4*a*. The surface layers H1*a* and H3*a* may have substantially the same thickness. The core H2*a* is preferably thicker than surface layers H1*a* and H3*a*.

The locking groove 14 and the locking element 8 can be formed with a small play or space as shown in FIG. 2*a* and this allows the floorboards to move horizontally such that swelling and shrinking is partly or completely compensated and that a semi-floating floor is obtained. The first 4*a* joint edge and the decorative surface layer 31 of the second 4*b* joint edge overlap each other at the mechanical joint system at an overlapping part 31*a*, and allow that such movement is obtained without any visible joint gaps. The overlapping part 31*a* is located under the horizontal main surface HP of the decorative surface layer 31. At the overlapping part 31*a*, the first joint surface 4*c* of the first 4*a* joint edge faces a second joint surface 4*d* of the second 4*b* joint edge and the first and the second joint surfaces are essentially parallel and essentially horizontal. The first and the second joint surfaces 4*c*, 4*d* are in contact, and the first and the second joint surfaces extend in a plane which is about 0-10° to the horizontal plane and they can be formed with a precise fit and this will prevent moisture from penetrating into the joint.

The joint system in FIG. 2*b* shows that the joint can be formed with tight fit or even pretension vertically and/or horizontally and this can be used to improve the moisture resistance. The upper part of the surface layer 31*a* can be machined and adjusted slightly in order to eliminate production tolerances. This means that the surface layer 31*a* over the tongue 10 can be made thinner than the surface layer 31 covering the main part of the floorboard 1'.

The portion TT can either be divided up into an upper joint edge portion and lower joint edge portion or not divided up into portions. Here the first joint edge 4*a* has a joint edge portion 18 and in a corresponding area the second edge 4*b* a joint edge portion 19. When the floorboards 1, 1' are pressed together, a portion of the surface layer 31 of joint edge portion 18 is located under the horizontal plane HP of the second joint edge 4*b*. More precisely a formed bevel is located under the horizontal plane HP if the horizontal plane HP is on the same level as the main floor surface. In the joint system, when the floorboards 1, 1' are joined and pressed towards each other, a portion of the surface layer 31 and a part of the core 30 of the joint edge portion 19 of the second joint edge 4*b* overlaps a portion of the surface layer 31 of the first joint edge 4*a*. An advantage of the first joint edge 4*a* having a portion of the surface layer H3*a* horizontal in the lower horizontal plane H3 overlapped by the surface layer H1*a* and the part of the core H2*a* of the second joint edge 4*b* of the joint edge portion 19 is that support is obtained during the movement between the two floor panels and without the visible joint gaps.

The surface layer 31 of the first 4*a* joint edge and the surface layer 31 of the second 4*b* joint edge overlap each other at the mechanical joint system at an overlapping part 31*a*, said overlapping part 31*a* is located under the horizontal plane HP of the decorative surface layer 31. A first joint surface 4*c* of the first joint edge 4*a* faces a second joint surface 4*d* of the second joint edge 4*b*, and the first and the second joint surfaces are essentially parallel and essentially horizontal. The first and the second joint surfaces 4*c*, 4*d* of the floorboards 1, 1' can then be in contact. The first and the second joint surfaces of the floorboards 1, 1' extend in a plane which is about 0-10° to the horizontal plane.

FIGS. 3*a*-3*d* illustrate a second exemplary embodiment with different dimensions of the special design of a mechanical joint system that allows semi-floating installation, according to the invention. The area TT of first joint edge 4*a* and second joint edge 4*b* are divided up into portions. The first joint edge 4*a* has a lower joint edge portion 17 positioned between the tongue 10 and the surface layer 31, and an upper joint edge portion 18' that is closer to the main floor surface HP than the lower joint edge portion 17, and the second joint edge 4*b* has a lower joint edge portion 16 positioned between the tongue 10 and the surface layer 31, and an upper joint edge portion 19' that is closer to the main floor surface HP than the lower joint edge portion 16. In the joint system, when the floorboards 1, 1' are joined and pressed towards each other, the upper joint edge portion 19' and a part of the core 30 in the second joint edge 4*b* overlap the surface layer 31 of the lower joint edge portion 17 of the first joint edge 4*a*.

Figure 4:
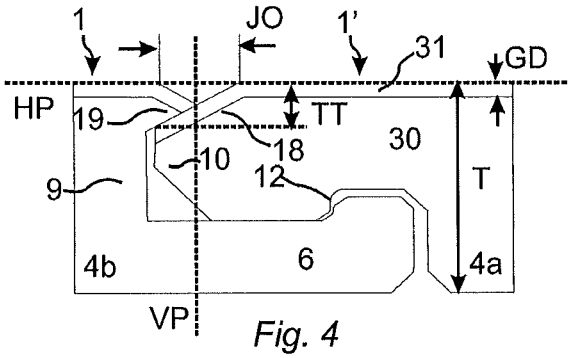
FIG. 4 is a special design of a mechanical joint system that allows semi-floating installation.

FIG. 4 illustrates a special design of a mechanical joint system that allows semi-floating installation. The first joint edge portion 18 is sloping away from the main floor surface HP. The second joint edge portion 19 with the surface layer 31 and a part of the core is overlapping the sloping surface layer 31 and the core 30 of the first joint edge portion 18.

Figure 5A:
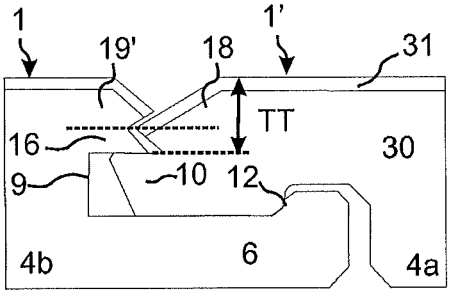
FIGS. 5*a*-5*b* are a third exemplary embodiment of a special design of a mechanical joint system, in two different positions, that allows semi-floating installation, according to the invention.
Figure 5B:
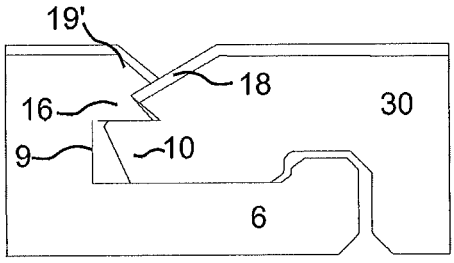

FIGS. 5*a*-5*b* illustrate a third exemplary embodiment of the special design of a mechanical joint system that allows semi-floating installation, according to the invention. The portion TT of second joint edge 4*b* is divided up into portions while the first joint edge 4*a* is not. The second joint edge 4*b* has a lower joint edge portion 16 positioned between the tongue 10 and the surface layer 31, and the upper joint edge portion 19' is closer to the main floor surface HP than the lower 16. When the floorboards 1, 1' are joined and pressed towards each other the joint edge portion 18 in the first joint edge 4*a* overlaps the lower joint edge portion 16 in the second joint edge 4*b*, and the upper joint edge portion 19' and a part of the core 30 in the second edge 4*b* overlap the surface layer 31 of the joint edge portion 18.

Figure 3A:
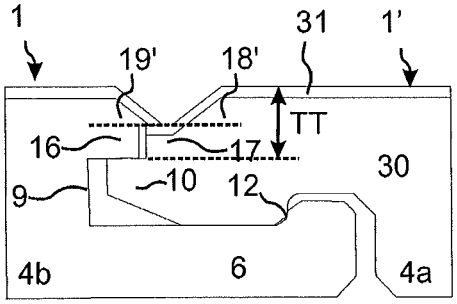
FIGS. 3*a*-3*d* are a second exemplary embodiment, with two different dimensions of a special design of a mechanical joint system, in two different positions, that allows semi-floating installation, according to the invention.
Figure 3B:
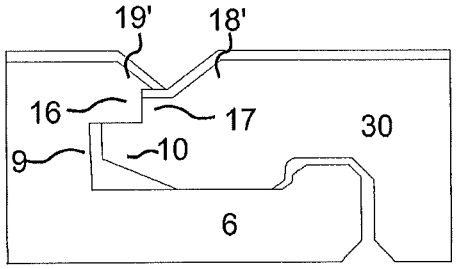
Figure 3C:
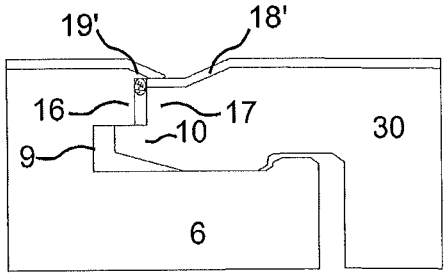
Figure 3D:
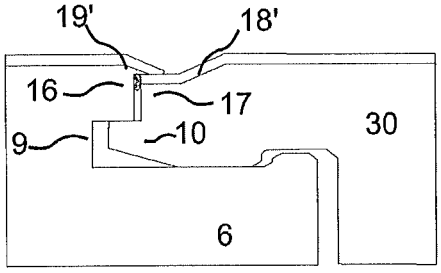

FIGS. 3*b*, 3*d* and 5*b*, illustrate the boards pressed together in their inner position, with the joint edge portions 16, 17 or 16, 18 in contact with each other, and FIGS. 3*a*, 3*c* and 5*a* illustrate the boards pulled out to their outer position, with the joint edge portions 18', 19' or 18, 19' spaced from each other.

Figure 6:
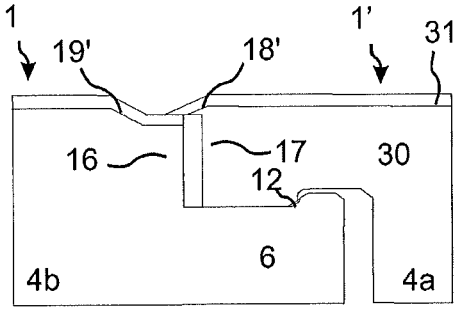
FIG. 6 is a fourth exemplary embodiment of a special design of a mechanical joint system, that allows semi-floating installation, according to the invention.

In the above exemplary embodiments, the overlapping joint edge portion 19' is made in the groove side, i.e. in the joint edge having a groove 9, in the second joint edge 4*b*. The overlapping joint edge portion 18, 18' can also be made in the tongue side, i.e. in the joint edge having a tongue 10, or in the first joint edge 4*a* as illustrated in FIG. 6.

A piece of flexible material can be applied reducing movements between two mechanically joined floor panels in the vertical plane VP on either the tongue or groove side, or both sides. Examples of flexible materials are plastic, rubber, and silicon or like material.

A piece of moisture removal material can be applied in the vertical plane VP on either the tongue or groove side, or both sides. This material prevents moisture to enter between two floor panels.

In the pressed-together position, the joint system has a play JO of for instance 0.2 mm. If the overlap in this pressed-together position is 0.2 mm, the boards can, when being pulled apart, separate from each other 0.2 mm without a visible joint gap being seen from the surface. The embodiments will not have an open joint gap because the joint gap will be covered by the overlapping second joint edge portion 19, 19' in FIGS. 3-5 and by overlapping first joint edge portion 18 in FIG. 6. It is an advantage if the locking element 6 and the locking grove 12 are such that the possible separation, i.e. the play, is slightly smaller than the amount of overlapping. Preferably a small overlapping, for example 0.05 mm, should exist in the joint even when the floorboards are pulled apart and a pulling force is applied to the joint. This overlapping will prevent moisture from penetrating into the joint. The joint edges will be strong since the overlapping edge portion 19, 19' in second joint edge 4*b* will be supported by the horizontal surface of the edge portion 18 of the first joint edge 4*a* of the adjacent floorboard in FIGS. 2, 4 and 5, or even stronger in FIGS. 3*a*-3*d*, since the lower edge portion 17 will support the upper edge portion 19'. The decorative groove can be made very shallow and all dirt collecting in the groove can easily be removed by a vacuum cleaner in connection with normal cleaning. No dirt or moisture can penetrate into the joint system and down to the tongue 10. This technique involving overlapping joint edge portions can, of course, be on one side only, or combined on both long sides or on both short sides, or combined on all sides on the floorboard including the long and short sides. For example, the visible and open joint gap can be 0.1 mm, the compression 0.1 mm and the overlap 0.1 mm. The floorboards' possibility of moving will then be 0.3 mm all together and this considerable movement can be combined with a small visible open joint gap and a limited horizontal extent of the overlapping joint edge portion 19, 19' that does not have to constitute a weakening of the joint edge. This is due to the fact that the overlapping joint edge portion 19, 19' is very small and also made in the strongest part of the floorboard, which comprises of the laminate surface, and melamine impregnated wood fibres. Such a joint system, which thus can provide a considerable possibility of movement without visible joint gaps, can be used in all the applications described above. Furthermore the joint system is especially suitable for use in broad floorboards, on the short sides, when the floorboards are installed in parallel rows and the like, i.e. in all the applications that require great mobility in the joint system to counteract the dimensional change of the floor. It can also be used in the short sides of floorboards, which constitute a frame, or frieze around a floor installed in a herringbone pattern. In an exemplary embodiment the vertical extent of the overlapping joint edge portion, i.e. the depth GD of the joint opening, is less than 0.1 times the floor thickness T. The overlapping joint edge can further be reinforced at the edge if desirable. For example by pre-processing the surface layer so the surface layer is reinforced at the edges or by an extra layer of reinforced material on the core of the grooves.

Figure 7A:
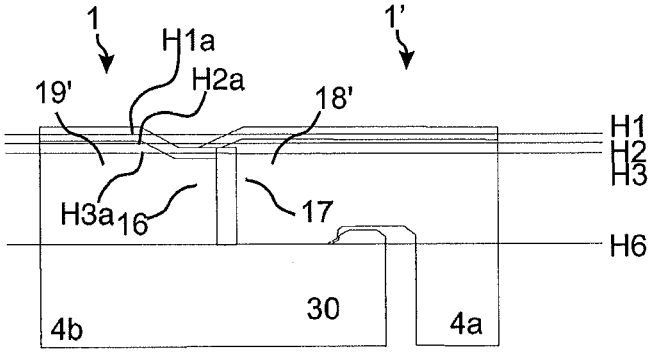
FIGS. 7*a*-7*c* are close-up views of exemplary embodiments according to the invention.
Figure 7B:
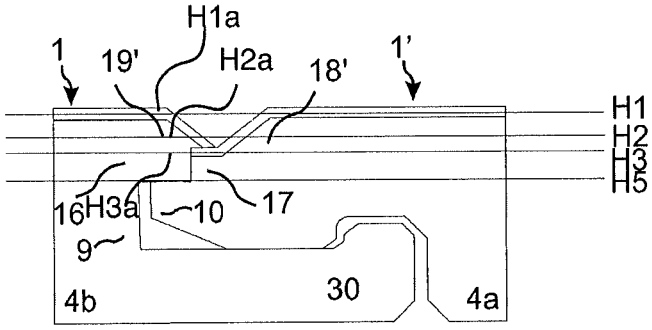
Figure 7C:
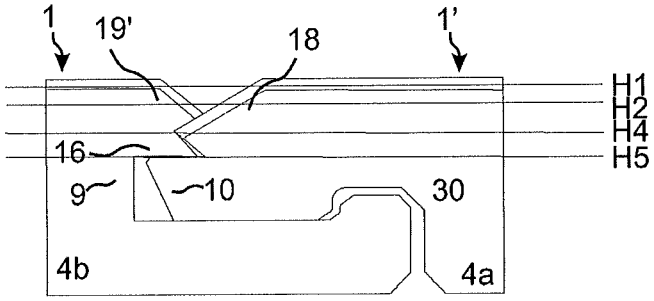

FIGS. 7*a*-7*c* illustrate in detail some parts of the exemplary embodiments of FIGS. 2-6, according to the invention. In FIG. 7*b*, the surface layer 31 and a part of the core 30 in second joint edge 4*b* of edge 1 are overlapping the surface layer in the adjacent floor board edge 1', or as in FIG. 7*a* the surface layer 31 and a part of the core 30 in floor board edge 1' of first joint edge 4*a* are overlapping the surface layer in the adjacent floor board edge 1. The edge part comprises a surface layer H1*a* in the first upper horizontal plane H1 horizontal to the main floor surface, a part of a panel core H2*a* and a surface layer H3*a* in the lower horizontal plane H3 lower than the main floor surface. A fifth horizontal plane H5 is parallel to the tongue 10 in the first joint edge 4*a* in FIGS. 7*b*-7*c*, and a sixth horizontal plane H6 is parallel to strip 6 of the locking element 8 in second joint edge 4*b* in FIG. 7*a*.

FIG. 7*a* illustrates the surface layer H1*a* in the upper first horizontal plane H1 parallel to the main floor surface HP, the surface layer H3*a* in the lower third horizontal plane H3 located under the main floor surface HP, and a part of the core H2*a* in the intermediate second horizontal plane H2 between the first and third horizontal planes. When the floorboards 1, 1' are joined and pressed towards each other the surface layer H1*a* and the part of the core H2*a* of the upper joint edge portion 18' in the first joint edge 4*a* overlap surface layer H3*a* adjacent to the joint edge 19' in the second joint edge 4*b*.

The invention provides further the exemplary embodiments of a production method to form deep core grooves 20', 20" in a panel with a thin surface layer. The advantage is that such deep core grooves can be formed very accurately without any substantial compression of the core, and in a production method with decreased production time and using little energy as well, thereby reducing the production cost.

Figure 8A:
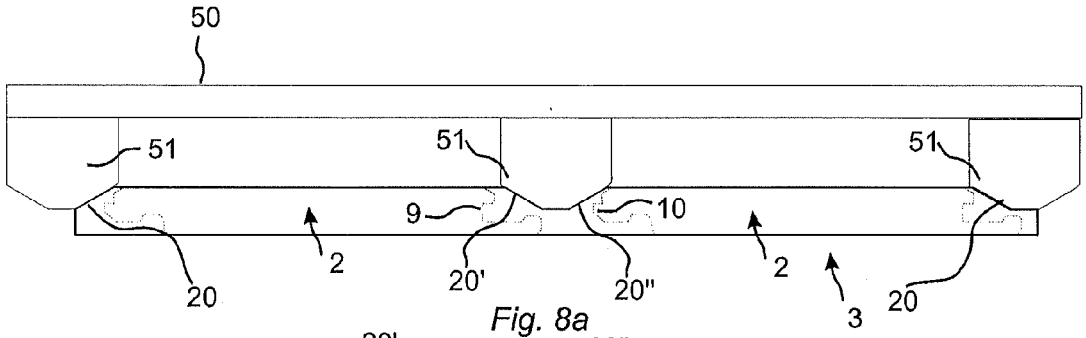
FIGS. 8-15 are exemplary embodiments of different manufacturing steps of a special design of a mechanical joint system that allows semi-floating installation, according to the invention.
Figure 8B:
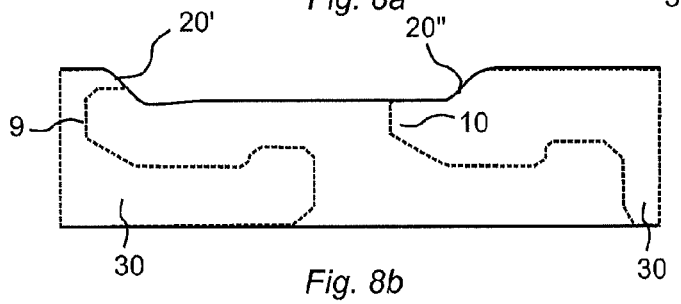

FIGS. 8-16 show parts of a production line illustrating exemplary embodiments of how to produce beveled building panels, decreasing the production cost, time and energy, according to the invention. The process of producing floorboards/building panels comprising pre-forming the core material of the whole floor element 3, without separating the floor panels 2 from each other, applying a top surface layer of e.g. wood veneer, laminate, layer of paint or a solid layer comprising wood fibre mix, binders and wear resistant particles or similar, forming the top surface layer 31 around the pre-formed core groves 20', 20" in the core material 30. The floor element 3 is then separated into floor panels 2. The method for manufacturing the floor panels 2 is here now described in the following method steps:

- machining a plurality of core grooves (20', 20") in the upper horizontal surface of a floor element (3);
- applying a top surface layer (31) on the core (30) of the floor element (3);
- applying a pressure on at least parts of the surface layer (31) such that the surface layer (31) follows the surface of the floor element and at least partly at least one of the core grooves (20', 20");
- cutting the floor element (3) into at least two floor panels (2) at at least one of the core grooves of the floor element (3), such that the floor panels comprise at least a part of the core groove at an edge of the floor panel FIG. 8*a* illustrates an exemplary embodiment of a production method to pre-form a core 30 with core grooves 20, 20', 20", which are intended to be covered with a surface layer 31, and formed as surface depressions in a floorboard preferably as beveled edges, according to the invention. FIG. 8*a* shows machining by rotating cutting tools. Preferably, saw blades 51 on an axel 50 can be used to cut core groves 20, 20', 20" which can be positioned such that they will cover an edge portion above the tongues 10 and grooves 9 in the joint system that will be formed at the edges of the floorboard as shown in FIG. 8*b*. Several other methods can be used to form the grooves by machining. Laser cutting or scraping, milling, or corroding are other alternatives to form the core 30 by machining the core groves 20, 20', 20'". An advantage of machining in this way is that the core surface is stable. As a person skilled in the art appreciates, the depressions can have a surface structure of core grooves 20, 20', 20" that can follow the sides of one floor panel on the two long sides, or follow just one long side, or further can follow the short sides or only the short sides can be followed by core grooves, depending on where the joint systems are to be positioned in the semi-floating floor. Core grooves can also be formed only for visual effects in the center of the floorboard for example, not shown.

Figure 9A:
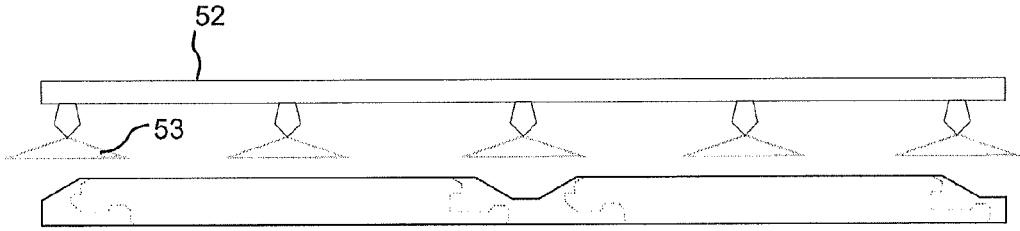

FIG. 9*a* illustrates the exemplary embodiment of adding adhesives 53 with a machine 52 to the core 30, on the pre-formed surface of the core, according to the invention. This facilitates the top surface layer 31 to be attached onto the core after pressing. As a person skilled in the art appreciates, any kind of adhesive can be used, e.g. polyvinyl acetate (PVA), aliphatic resin emulsion or other synthetic resins including resorcinol, urea-formaldehyde, phenol formaldehyde resin, etc., just to mention some.

Figure 9B:
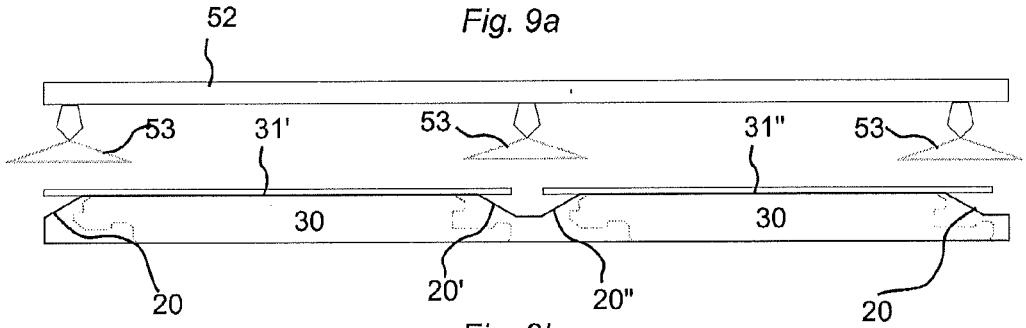

FIG. 9*b* illustrates the exemplary embodiment of humidifying 53 with a machine 52 the top surface layer 31', 31" prior to pressing, according to the invention. This facilitates for example the bending of a wood fibre based top surface layer such as paper or wood veneer around the portions of the pre-formed groove 20 of the core 30, i.e. the surfaces which are lower than the main floor surface. As a person skilled in the art appreciates any way of humidifying 53 can be done, e.g. by spraying, steaming, painting liquid or lubricating, and any kind of humidifier 53 can be used such as, e.g. water, oil or wax, etc., just to mention some. Further, the top surface layer 31', 31" can be heated up to soften the top surface layer, which will then be more easily formed during pressing.

The method can be used to form the core grooves and the main floor surface in the same production step. A paper impregnated with, for example, a thermosetting resin can be applied over the core groove and, under heat and pressure, thereby forming around the depression and curing the top surface layer.

The method is particularly suitable to form for example deep depressions in floorboards comprising a solid surface of wood fibres, binders and wear resistant particles.

The method does not exclude that the core and/or parts of the core groove are partly compressed during the application of the surface layer over the core groove.

Figure 10A:
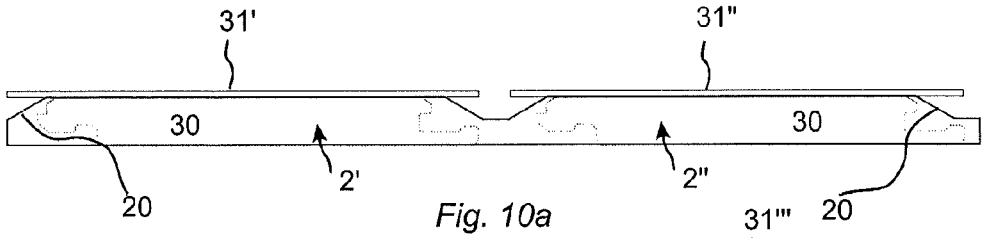
Figure 10B:
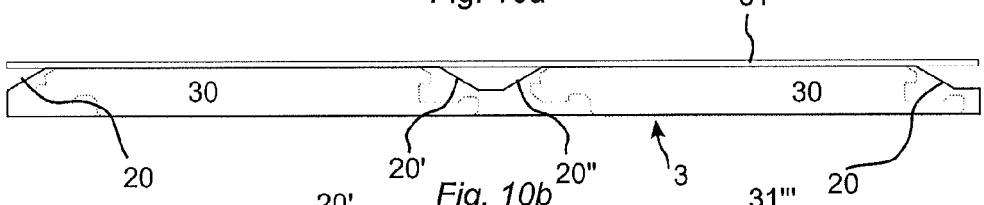
Figure 10C:
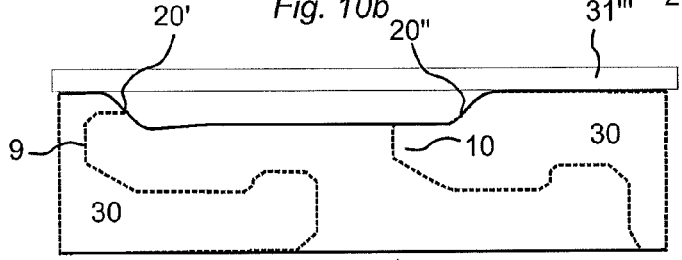
Figure 11:
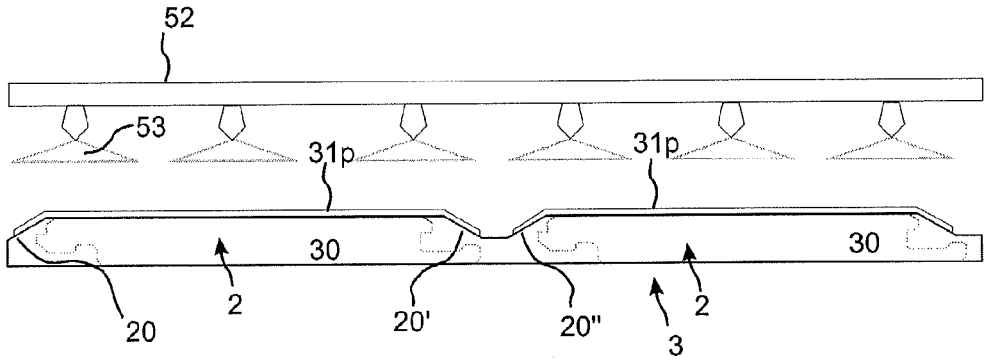

FIG. 10*a* illustrates the exemplary embodiment where each floor panel 2', 2" is more or less covered by a separated sheet 31', 31" of a top surface layer, according to the invention. FIG. 10*b* illustrates the embodiment, when the top surface layer 31'" is covering a whole floor element 3, which can be stretched out a bit when pressed down between the bevels 20, 20', 20", according to the invention. FIG. 10*c* illustrates a close-up view of FIG. 10*b* where it can be seen that a thin top surface layer 31'" is applied to the core 30 such that it covers the core grooves. FIG. 11 illustrates the exemplary embodiment according to the invention, where a top surface layer 31*p* is applied as powder, comprising fibres and binders, on the defined form following the contour of the pre-formed core. An example of a powder is WFF defined in WO 2009/065769. The powder applied over the core groove can be of a different color than the main floor surface. This could be used to form deep grout lines with a different colour or structure than the main floor surface. The powder can be scattered to cover at least one core groove, and the powder can further then be lubricated if needed.

Figure 12A:
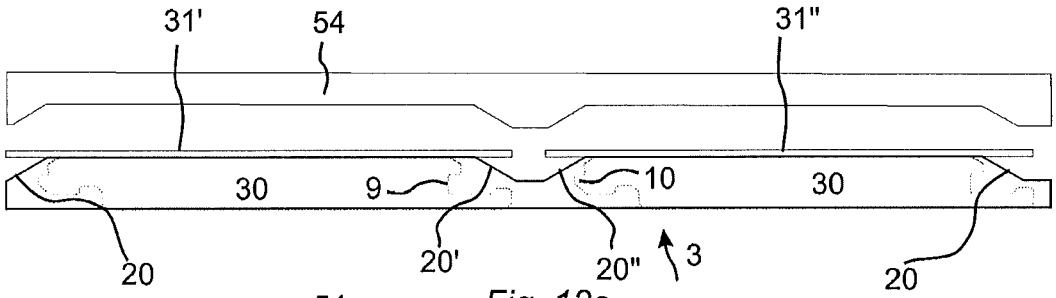
Figure 12B:
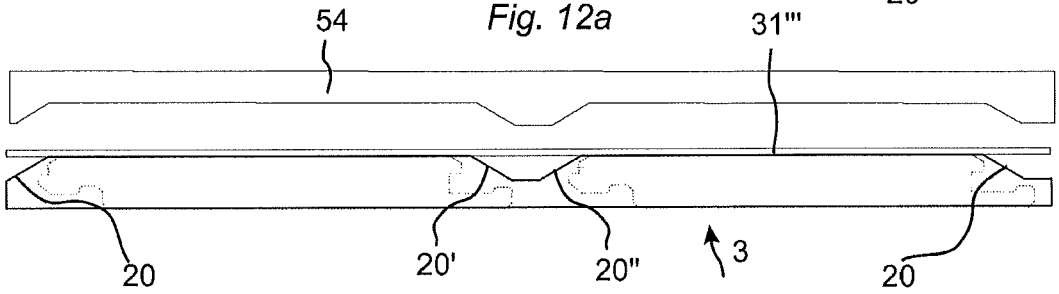
Figure 12C:
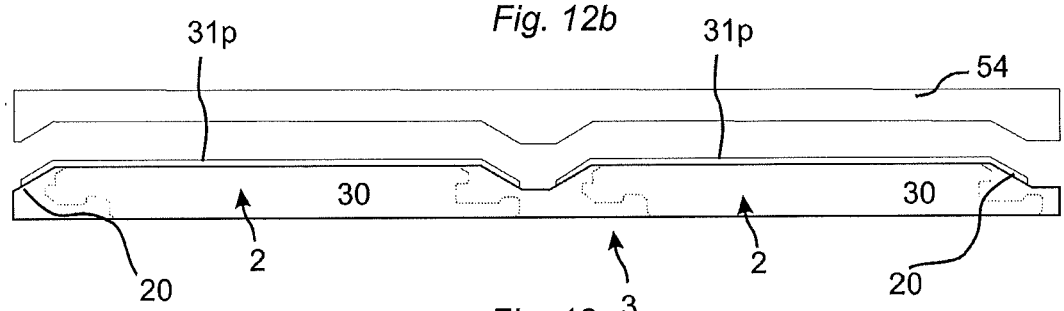
Figure 12D:
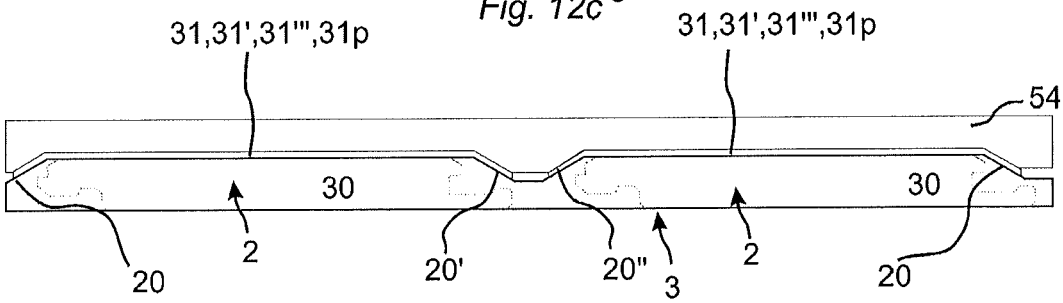
Figure 12E:
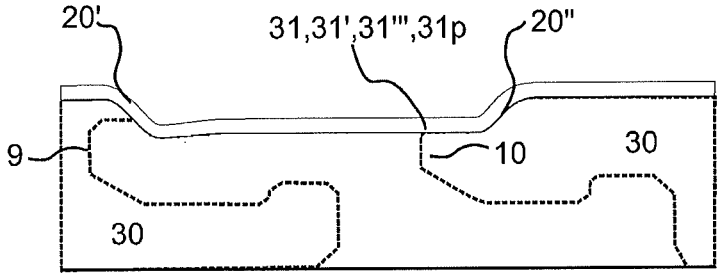

FIGS. 12*a*-12*c* illustrate the exemplary embodiment of pressing on different top surface layer 31', 31", 31'", 31*p* in a first step, according to the invention, using e.g. a fixed pressure plate 54, with a defined form following the contour of the pre-formed core groves (20, 20', 20"). The pressing plate 54 shown, as a person skilled in the art appreciates, can have any form that suits the surface layer to be pressed. The top surface layer can be glued to the core or laminated under heat and pressure as an impregnated paper 31', 31", 31'" or applied as a powder 31*p* comprising fibres and binders. FIG. 12*d* illustrates the second step where the pressing plate 54 is in a pressing position. FIG. 12*e* shows the result after pressing. Scraping, cutting or corroding can shape the surface structure of the upper surface of the core, and the sheets 31, 31', 31", 31'" of the top surface layer or powder mix then follows with the pressing. The top surface layer can also be pre-processed before it is pressed, e.g. with scraping or cutting the laminate sheets 31, 31', 31'" with patterns. Further the upper surface layer can comprise a moisture repellant material.

Figure 13A:
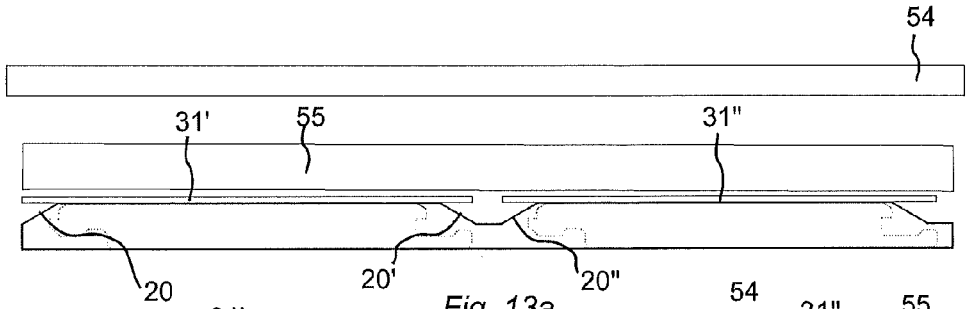
Figure 13B:
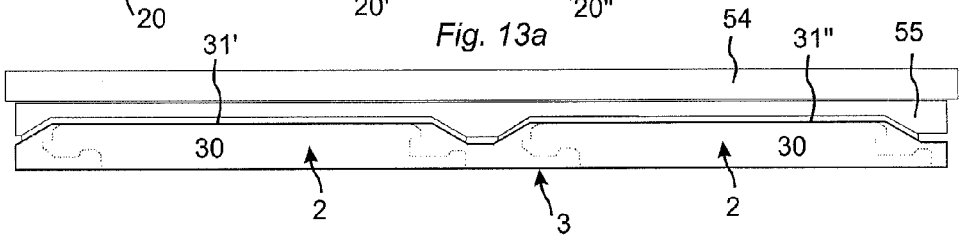

FIGS. 13*a*-13*b*, illustrate the embodiment of a soft pressuring equipment 54, 55, working for example with a soft mattress 55 between the flat formed press 54 and the top surface layer 31', 31", according to the invention. When pressing the flat press 54, the mattress 55 bulks out into where the open spaces are, due to the pre-formed core groves (20', 20") on the surface of the core 30. The bulked part of the mattress 55 presses the top surface layer 31', 31" even over the surface laying lower, helping the top surface layer 31 to follow the contour of the core 30 surface, and attaching the top surface layer 31. As a person skilled in the art appreciates, the pressing plate can have any form that suits the surface layer to be pressed together with the mattress 55.

Figure 14A:
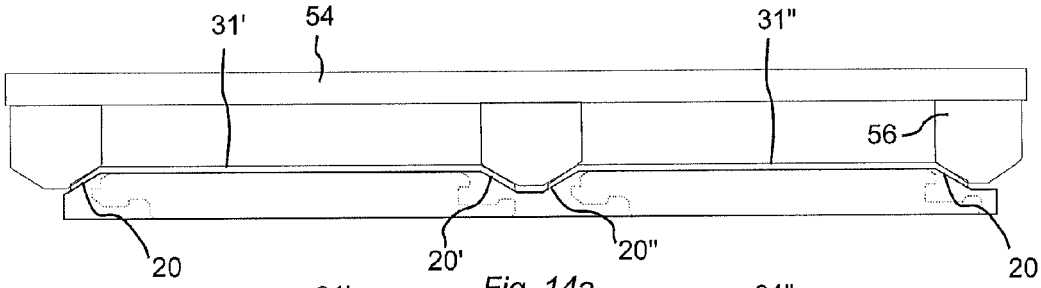
Figure 14B:
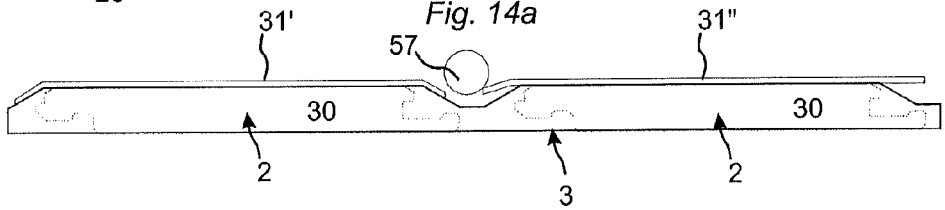

FIGS. 14*a*-14*b*, illustrate the embodiment of a press plate 54 having only protruding portions 56 that are corresponding to the core groves (20', 20") and a roller 57 rolling over the top surface layer 31, according to the invention. Both the protruding portions 56 and roller 57 are following the contour surface, attaching the top surface layer to the surface of the core 30, particularly attaching the top surface layer to the pre-formed bevels 20.

Figure 15:
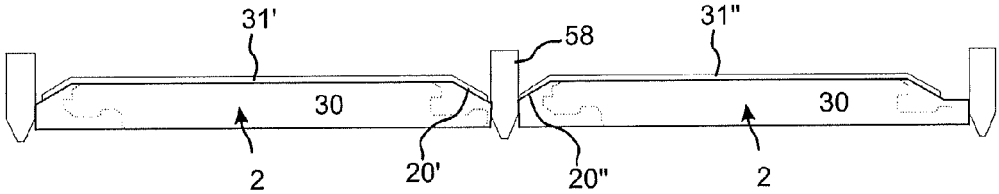

FIG. 15 illustrates the embodiment of the step after the pressing step, which is separating the floor element 3 into floor panels 2 with a cutter 58.

FIGS. 16*a*-16*f*, illustrate the embodiment of the different steps the floor element 3 go through during the production line, according to the invention. FIG. 16*a* illustrates the floor element 3. FIG. 16*b* illustrates the floor element 3 after the pre-forming of the core 30. Top surface layer sheets 31' are applied in FIG. 16*c*. After pressing, the sheets are attached in FIG. 16*d*. The floor element 3 is separated into floor panels 2 and the joint systems are machined in FIG. 16*e*. FIG. 16*f* illustrates the surface layers not overlapping each other, an exemplary design of a mechanical joint system according to known art, not allowing semi-floating, where the manufacturing method according to the invention is suited for as well.

The exemplary embodiments of manufacturing methods, in FIGS. 8-16, can be used in the production of the exemplary embodiments of the building panel, in FIGS. 2-7, with a special design of a mechanical joint system that allow semi-floating installation.

It will be understood by those skilled in the art that various modifications and changes may be made to the present invention without departure from the scope thereof, which is defined by the appended claims.

The invention claimed is:

1. A method for manufacturing floor panels having a front side and an opposing rear side for facing a subfloor, wherein the method comprises the steps of:

machining a plurality of core grooves in the upper horizontal surface of a floor element, the upper horizontal surface facing the front side;

applying a top surface layer on a core of the floor element;

applying a pressure on at least parts of the top surface layer such that the top surface layer follows the surface of the floor element and at least partly the surface of at least one of the core grooves;

cutting the floor element into at least two floor panels at at least one of the core grooves of the floor element, such that the floor panels comprise at least a part of the core groove at an edge of the floor panel.

2. The method according to claim 1, wherein the method further comprises the step of forming a mechanical joint system at the edge of the floor panel.

3. The method according to claim 1, wherein the core grooves are machined by mechanical cutting, or milling, or scraping prior to applying the top surface layer.

4. The method according to claim 1, wherein the top surface layer is applied by applying a powder mix of fibres and binders and wear resistant particles, and applying the pressure on at least parts of the mix giving the result of a compact top surface layer.

5. The method according to claim 4, wherein the powder mix is scattered to cover at least one core groove.

6. The method according to claim 1, wherein at least one of the cut core grooves comprises a bevel for at least one side of each floor panel.

7. The method according to claim 1, wherein at least three core grooves are formed and the three core grooves comprise the structure of at least two floor panels with bevels on two sides of each floor panel.

8. The method according to claim 1, wherein the top surface layer comprises a plurality of separated sheets.

9. The method according to claim 8, wherein the separated sheets each cover a floor panel or a plurality of floor panels.

10. The method according to claim 8, wherein the separated sheets extend into and end in the core grooves.

11. The method according to claim 1, wherein the pressure is applied by a vertical pressing or rolling a roller or a combination of vertical pressing and rolling a roller.

12. The method according to claim 1, wherein the pressure is applied by a pressure plate comprised of material that will follow the contour of the plurality of core grooves.

13. The method according to claim 1, wherein the pressure is applied by a pressure plate comprised of at least one fixed pressure plate with a form adapted to the form of the plurality of core grooves or with a flat form.

14. The method according to claim 13, wherein a flexible soft mattress is positioned on top of the top surface layer under the pressure plate.

15. The method according to claim 1, wherein the top surface layer is glued to the core of the floor element or laminated under heat and the pressure.

16. The method according to claim 1, comprising humidifying or lubricating or lacquering or oiling or putting adhesives to the core of the floor element prior to pressing.

17. The method according to claim 1, comprising applying a piece of flexible material which reduces movements between two mechanically joined floor panels in the vertical plane on either a tongue or groove side of the floor panels.

18. The method according to claim 1, comprising applying a piece of moisture removal material in the vertical plane on either a tongue or groove side of the floor panels.

19. A method for manufacturing floor panels, wherein the method comprises the steps of:

machining a plurality of core grooves in the upper horizontal surface of a floor element;

applying a top surface layer on a core of the floor element;

applying a pressure on at least parts of the top surface layer such that the top surface layer follows the surface of the floor element and at least partly the surface of at least one of the core grooves; and cutting the floor element into at least two floor panels at at least one of the core grooves of the floor element, such that the floor panels comprise at least a part of the core groove at an edge of the floor panel;

wherein the top surface layer comprises laminate or wood veneer.

20. The method according to claim 1, wherein the top surface layer is applied on the core of the floor element after the machining.

21. The method according to claim 1, wherein the step of cutting the floor element into at least two panels involves cutting at at least one of the core grooves along the length of the at least one of the core grooves.

22. The method according to claim 1, wherein the top surface layer covers a majority of the surface of the floor element.

23. The method according to claim 1, wherein the top surface layer is a sheet of material.

24. The method according to claim 1, wherein the top surface layer is applied to a portion of the upper horizontal surface that is at a distance from the plurality of core grooves, and the top surface layer extends from the portion to at least partly over at least one of the plurality of core grooves.

25. The method according to claim 1, wherein the top surface layer forms at least one of a cantilever and a bridge over at least one of the plurality of core grooves when the top surface layer is applied on the core of the floor element.

26. The method according to claim 1, wherein the top surface layer is applied on a surface of the core that faces the front side of the floor panels.

27. A method for manufacturing floor panels, wherein the method comprises the steps of:

machining a plurality of core grooves in the upper horizontal surface of a floor element;

applying a top surface layer above the upper horizontal surface on a core of the floor element;

applying a pressure on at least parts of the top surface layer such that the top surface layer follows the surface of the floor element and at least partly the surface of at least one of the core grooves;

cutting the floor element into at least two floor panels at at least one of the core grooves of the floor element, such that the floor panels comprise at least a part of the core groove at an edge of the floor panel.

* * * * *